United States Patent [19]

Yang

[11] Patent Number: 4,776,589

[45] Date of Patent: Oct. 11, 1988

[54] LIGHTED INFLATABLE BALL

[76] Inventor: Chao-Ming Yang, 2Fl., 17-1, Lane 2 Kwang-Wu St., Pan Chiao, Taiwan

[21] Appl. No.: 7,653

[22] Filed: Jan. 28, 1987

[51] Int. Cl.[4] ..... A63B 43/06

[52] U.S. Cl. ..... 273/58 G; 273/DIG. 5

[58] Field of Search ..... 273/58 G, 58 R, 58 B, 273/58 BA

[56] References Cited

U.S. PATENT DOCUMENTS

| | | | |
|---|---|---|---|
| 2,020,484 | 11/1935 | Turner | 273/58 G |
| 2,838,872 | 6/1958 | Beck | 46/87 |
| 2,849,819 | 9/1958 | Murphy et al. | 46/230 |
| 2,903,820 | 9/1959 | Bodell | 273/58 G |
| 3,058,261 | 10/1962 | Lakin | 46/99 |
| 3,304,651 | 2/1967 | Deyerl | 273/58 G |
| 3,580,575 | 5/1971 | Speeth | 273/58 G |
| 4,179,832 | 12/1979 | Lemelson | 46/88 X |
| 4,282,680 | 8/1984 | Zaruba | 46/227 |
| 4,292,999 | 10/1981 | Szolimann | 46/88 X |
| 4,335,538 | 6/1982 | Greenberg | 46/88 |

FOREIGN PATENT DOCUMENTS

| | | | |
|---|---|---|---|
| 1172585 | 6/1964 | Fed. Rep. of Germany | 273/58 G |

*Primary Examiner*—George J. Marlo

*Attorney, Agent, or Firm*—Holman & Stern

[57] ABSTRACT

The present invention relates to a novel lighted inflatable ball having a novel structural design to enable the inflatable ball to be lighted at night for recreation. A hollow compartment of soft PVC membrane is centrally provided in an inflatable ball. One end of the hollow compartment is closed and the other end closable by a closure. A battery cell holder with switch is insertable in the hollow compartment. Wiring from the cell holder passes through the soft membrane layer by means of a blockading member in which the wiring is airtightly fused. The cell wiring is connected to bulb wiring of a plurality of bulbs fixed in projecting rings molded on outer sides of the hollow compartment.

2 Claims, 3 Drawing Sheets

LIGHTED INFLATABLE BALL

BACKGROUND OF THE INVENTION

The advance of time and the rapid development of business influence the public's view of the value of products with regard to their novelty and practicability. Particularly, the recreational fun products, if possessing no creative and unique structural design at all, would have to be gradually discontinued because of unsalability. For instance, the making of inflatable balls is ever changing for continued improvement such as the formative design of cartoon characters and animals in order to meet the consumers' psychological requirement for novelty. However, the conventional structural design of inflatable balls has no innovation except for some change of appearance which cannot meet the consumers' psychological requirement for novelty, and the conventional inflatable ball cannot be used for fun when camping on a beach or grass land at night under conditions of dim light, and thus the usefulness of the conventional inflatable balls is certainly diminshed.

There are known some designs for lighted ball structures such as those disclosed in U.S. Pat. Nos. 4,179,832, 4,292,999, 4,335,538, 2,849,819, 3,058,261, 4,282,680 and 2,838,872 and in German Pat. No. 1,172,585 which leave much to be desired; for instance, the bulb installed outside the ball tends to be broken, the hard ball shell assembled by means of spiral turning is not collapsible to be narrowed, and the power source wires shuttling in the ball lead to a poor airtight performance; all of these drawbacks are unacceptable for the consumers. Therefore, the structural design of the inflatable ball has to be further improved in fact.

In view of the usefulness and structural design of conventional inflatable balls leaving much to be desired, the present inventor, who has been engaged in and is well-experienced in manufacturing various plastic inflatable products for a number of years, through continued experimentation and research concerned for improvement with a plurality of results, eventually invented a lighted inflatable ball structure which can meet the consumers' psychological requirement for novelty and fit their use.

SUMMARY OF THE INVENTION

A novel lighted inflatable ball, particularly an inflatable ball which is characterized by a hollow compartment of a soft membrane PVC layer at the central part of the ball for installing such members as a bulb and battery cell thereon, so that the inflatable ball may be lighted to be played with for fun even at night or in dark places such as a beach, swimming pool or lawn in order to improve its practicability and novelty.

DETAILED DESCRIPTION OF THE PREFERRED EMBODIMENT

Figure 1:
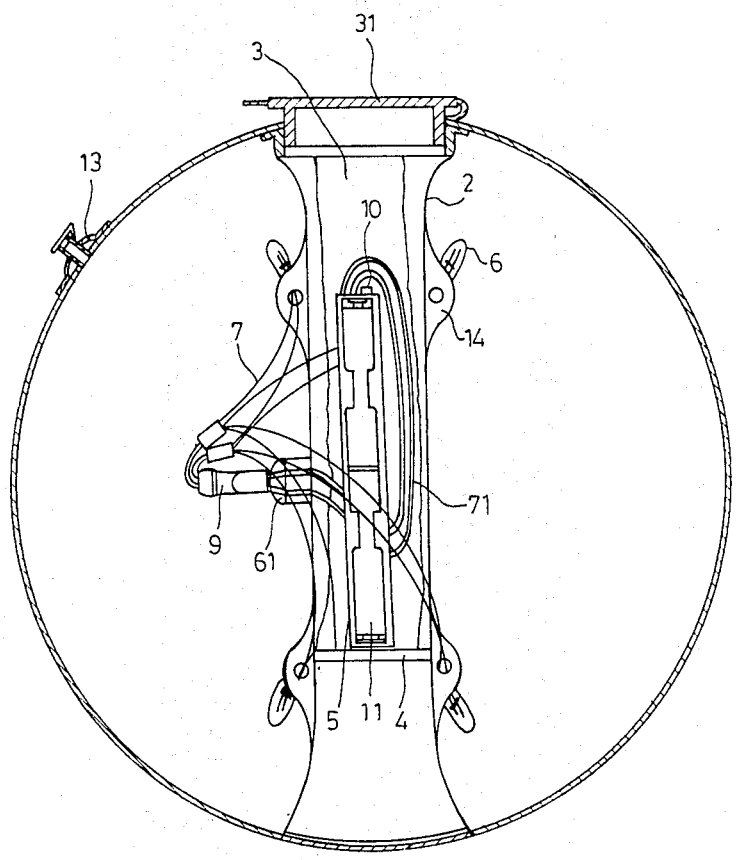
FIG. 1 is a sectional view of the structure of this invention.
Figure 2:
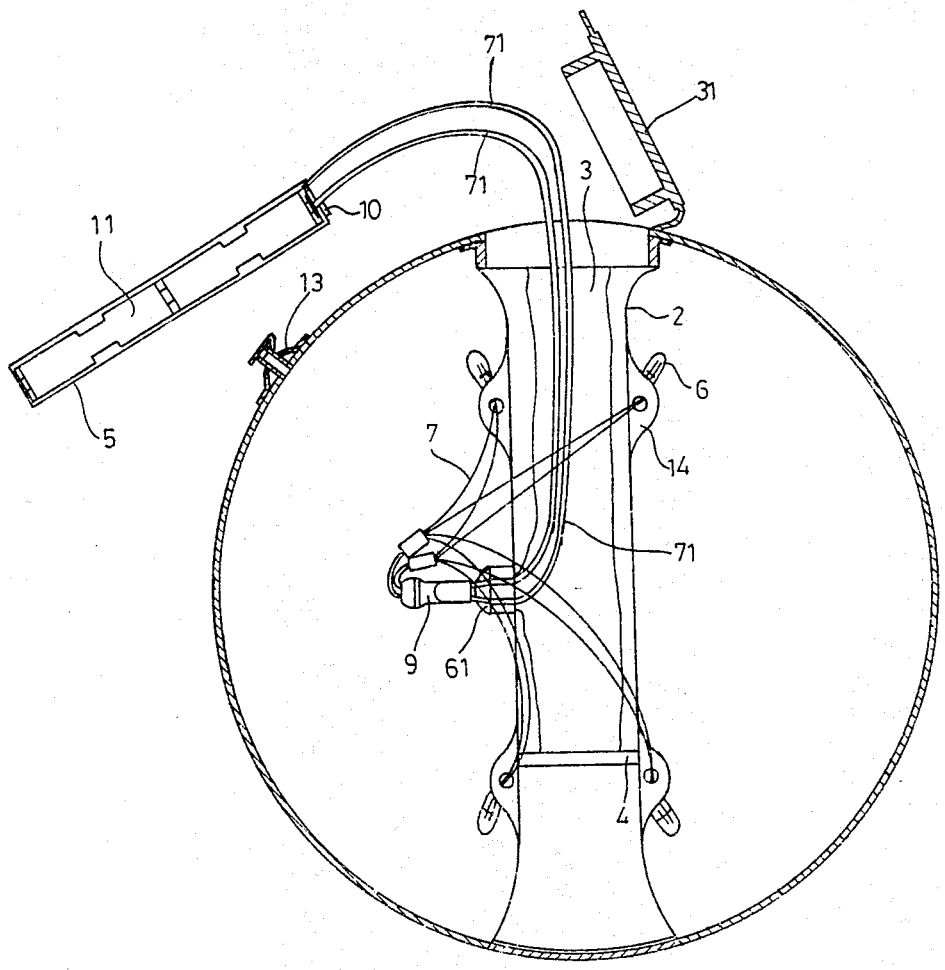
FIG. 2 is an example of this invention with battery cell installed.

In order to facilitate further understanding of the structure and function of this invention, it is described in detail below in conjunction with the accompanying drawings:

As shown in FIG. 1, the central part of an inflatable ball 1 is provided with a hollow compartment 3 composed of two soft membrane PVC layers 2. A closed zone 4 is provided at the lower end of the hollow compartment 3 near the center thereof, and the top end thereof is provided with a closure 31 which is waterproof so that the ball can be played with in the water. A change-over switch 10 for ON and OFF operation is provided on the end surface of a battery cell holder 5 which is nearest the closure 31 so that the user can control the turning on or off of a bulb 6. In addition, four bulbs 6 can be fixed on four projected rings 14 which are molded in suitable positions on the outer sides at the upper and lower ends of the soft membrane PVC layers 2, respectively. The color of bulb 6 may be in keeping with the color of inflatable ball 1, depending on the consumers' requirement. A blockading member 61 is molded on one side in a suitable position of the PVC layer 2 so that the cell conducting wire 71 in the PVC layer 2 may maintain an absolute air-tight effect through its passage out therethrough.

Figure 3:
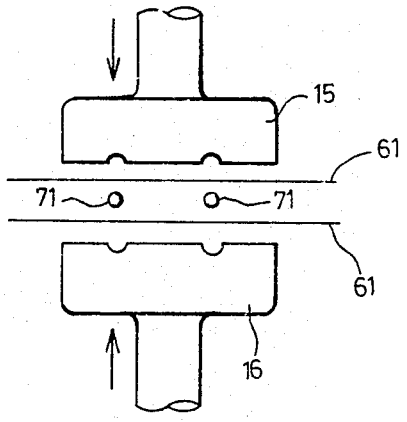
FIG. 3 is a structural view of the fusion between a blockading member and conducting wire of this invention.

As shown in FIG. 3, the pressing together of an upper die 15 and a lower die 16 can fuse the cell conducting wire 71 and the blockading member 61 into one body. When the cell conducting wire 71 has passed out of the blockading member 61, a junction box 9 is provided to movably connect the cell conducting wire 71 to the bulb conducting wire 7; and during the fusing operation, the bulb 6 will not be damaged. Since the high-cycle fusion of blockading member 61 is performed in an oscillatory manner, an instantaneous high tension will have to be generated to damage the bulb 6, so a junction box 9 has to be provided. When proceeding with the high-cycle fusing operation, the cell conducting wire 71 and the bulb conducting wire 7 may be removed to be separate from each other, and then inserted for connecting with each other, the bulb 6 and the manufacturing process concerned will not be affected.

The circuit of this invention is well known by those who engage in the art concerned, so it is unnecessary to reiterate herein. How to put this invention into practice is hereby described as follows:

When operating this invention, prior to the inflation of ball 1 via air nozzle 13, it is necessary to remove the cell holder 5 from the hollow compartment 3 and to install the battery cell 11 in the cell holder 5; and then to turn ON the change-over switch 10 and place the cell holder 5 back in the hollow compartment 3 to be just above the closed zone 4, namely, just at the center of inflatable ball 1, so as to enable the inflatable ball 1 to maintain its balance during throwing and flying; and finally, to inflate the ball 1 (since the blockading member 61 is provided on the hollow compartment 3 of PVC layer 2, the air-tightness is high to absolutely block any air from permeating into the hollow compartment 3). When the air is inflated into the ball to be in a state of full inflation, the upper wall of ball 1 on the two end sides of hollow compartment 3 will gradually press the soft membrane PVC layer 2 inward so as to gradually narrow the hollow compartment 3 to cover and position the cell holder 5 without loose displacement to form a novel inflatable ball capable of being lighted.

In view of the above, it is obvious that the primary object of this invention is to offer an inflatable ball capable of being lighted so as to enhance its novel function for use.

The secondary object of this invention is to make use of the structure thereof to permit playing with the inflatable ball at night or in a dark place so as to improve its effect because of its lighting.

Another object of this invention is to make use of the structure thereof to permit taking out of the cell holder for replacing the cell and to control the switch for turning on or off the bulb therein from time to time.

In summary, this invention is characterized by the foregoing advantages to enhance its novelty and practicability as well as the unprecedented effect which the conventional one lacks. The embodiment described above shows an easier example but is not intended to limit this invention. It will be apparent to those who are skilled in the art that the disclosed novel lighted inflatable ball may be modified and applied in numerous equivalent effects without departing from the spirit of this invention. Therefore, it is intended by the appended claims to cover all such modifications of this invention.

I claim:

1. A lighted inflatable ball comprising:

a inflatable ball having a wall and an air nozzle (13) therein for inflation thereof;

a hollow compartment (3) provided at a central portion of said inflatable ball, said hollow compartment (3) being formed of two soft PVC membrane layers (2) joined together at side edges thereof and joined at ends thereof to said wall, with a plurality of projecting rings (14) being molded on outer sides of upper and lower ends of said soft PVC membrane layers (2), said hollow compartment (3) being closed at a lower end thereof near the center thereof by a closed zone (4), said hollow compartment (3) being closable at an open upper end thereof by a waterproof closure (31);

a battery cell holder (5) insertable in said hollow compartment (3), an ON-OFF switch (10) being provided on said battery cell holder (5);

a blockading member (61) molded on a side of said hollow compartment (3), cell conducting wiring (71) from said battery cell holder (5) passing airtightly through said blockading member (61); and a plurality of lamp bulbs (6), each fixed on one of said projecting rings (14), bulb conducting wiring (7) from said lamp bulbs (6) being connected with said cell conducting wiring (71);

wherein said cell conducting wiring (71) from said battery cell holder (5) is fused and molded between the soft PVC membrane layers (2) at a side of said hollow compartment (3) at said blockading member (61), whereby airtight passage of said cell conducting wiring (71) out through said soft PVC membrane layers (2) of said hollow compartment (3) is provided for preventing air permeation from said inflatable ball into said hollow compartment (3);

and wherein, when said inflatable ball is fully inflated, tension is exerted by the wall of the inflatable ball on the soft PVC membrane layers (2) of the hollow compartment (3) to thereby press the soft PVC membrane layers (2) inward to narrow the hollow compartment (3) for positioning the battery cell holder (5) therein.

2. A lighted inflatable ball according to claim 1, wherein said bulb conducting wiring (7) from said lamp bulbs (6) is connected to said cell conducting wiring (71) externally of said hollow compartment (3) by a junction box (9)

* * * * *